US007690371B2

(12) United States Patent
Slaven

(10) Patent No.: US 7,690,371 B2
(45) Date of Patent: Apr. 6, 2010

(54) TOY GUN

(75) Inventor: Michael Howard Slaven, Buena Park, CA (US)

(73) Assignee: The Oldtimer, LLC, Buena Park, CA (US)

( * ) Notice: Subject to any disclaimer, the term of this patent is extended or adjusted under 35 U.S.C. 154(b) by 351 days.

(21) Appl. No.: 11/839,547

(22) Filed: Aug. 16, 2007

(65) Prior Publication Data

US 2008/0087261 A1 Apr. 17, 2008

Related U.S. Application Data

(60) Provisional application No. 60/829,062, filed on Oct. 11, 2006.

(51) Int. Cl.
*F41B 7/02* (2006.01)
*F41B 7/08* (2006.01)

(52) U.S. Cl. ..... 124/18; 124/19

(58) Field of Classification Search ..... 124/18, 124/19

See application file for complete search history.

(56) References Cited

U.S. PATENT DOCUMENTS 1,729,917 A * 10/1929 Webb ..... 124/18
2,535,891 A * 12/1950 Bozarth ..... 124/18
2,642,057 A * 6/1953 Watkins ..... 124/17
2,692,593 A * 10/1954 Flores, Jr. ..... 124/18
2,730,094 A * 1/1956 Hicks ..... 124/19
4,436,077 A 3/1984 Smith
4,554,904 A 11/1985 Endo
4,827,892 A 5/1989 Vandermeide
5,595,165 A 1/1997 Conte

OTHER PUBLICATIONS

Title "Rubber band guns" from Wikipedia web page (http://en.wikipedia.org/wiki/Rubberband_gun), date unknown, author unknown; three (3) pages.

* cited by examiner

*Primary Examiner*—John Ricci
(74) *Attorney, Agent, or Firm*—Heidi L. Eisenhut; Loza & Loza, LLP

(57) ABSTRACT

A toy gun for launching projectiles is provided. The gun includes a stock having a first end and a second end, where the first end is secured to an elongated barrel; and a trigger mechanism is secured on the stock adjacent to the elongated barrel for launching the projectiles. The trigger mechanism includes a release mechanism having a lower leg connected to the stock and an upper leg connected to the bottom leg by a spring and the upper leg is moveable between a first position and a second position. The trigger mechanism also includes at least one retaining member extends upwardly through a longitudinal slits in the upper leg. As the release mechanism is moved from the first position to the second position, the projectile attached to the trigger mechanism is launched.

19 Claims, 7 Drawing Sheets

TOY GUN

CLAIM OF PRIORITY UNDER 35 U.S.C. §119

The present Application for Patent claims priority to U.S. Provisional Application No. 60/829,062 entitled "Triggering device for a rubber band gun/rifle" filed Oct. 11, 2006, and hereby expressly incorporated by reference herein.

FIELD

The present invention relates to the field of toy guns, in particular, a gun-like device that launches projectiles.

BACKGROUND

A rubber band gun is a toy gun used to fire one or more rubber bands (or "elastic loop bands"). Typically, in such guns, a rubber band is stretched and retained lengthwise along the barrel of the gun and a trigger mechanism is provided for releasing the rearward end of the stretched rubber band so that the band is projected from the muzzle end of the barrel.

One type of prior art gun includes a repeater (or revolver) rubber band gun that is capable of firing 10 or more rubber bands, semi-automatically. The repeater rubber band gun is usually made of wood, and has a plastic firing mechanism, consisting of a toothed cogwheel onto which the bands are hooked. A band is hooked around the front or nozzle of the barrel, and stretched back to the first tooth of the cogwheel. The wheel is turned backward one notch, and the next band is hooked on. Once all teeth on the wheel are loaded, the gun is ready to fire. A trigger releases the wheel by one notch launching or releasing a rubber band. Every time the trigger is pulled a rubber band is launched until there are no more rubber bands to launch. However, this prior art gun is difficult to operate as loading and firing of the gun is complicated.

Another type of prior art gun includes a Gatling gun consisting of between 3 and 12 repeater rubber band guns arranged on a cylindrical rotor. The rotor rotates and each individual barrel is fired as it reaches the top of its locus. To rotate the rotor, an individual manually rotates a crank handle. However, this prior art gun is also difficult to operate as the loading and firing of the gun is complicated.

Consequently, a rubber band gun is needed that is easy to load and fire.

SUMMARY OF THE PRESENT INVENTION

In one aspect of the present invention, a toy gun for launching projectiles, such as rubber bands, is provided. The gun includes a stock having a first end and a second end, where the first end is secured to an elongated barrel having a muzzle end and a non-muzzle end; and a trigger mechanism is secured on the stock adjacent to the non-muzzle end of the elongated barrel for launching the rubber bands. The trigger mechanism includes a release mechanism having a lower leg connected to a top portion of the stock and an upper leg connected to the lower leg by a spring and wherein the upper leg is moveable between a first position and a second position. The trigger mechanism also includes at least one retaining member extending upwardly through longitudinal slits in the upper and lower legs. As the release mechanism is moved from the first position to the second position, the upper leg of the release mechanism comes into contact with the rubber band pushing the rubber band over the retaining member and launching or deploying the rubber band.

The foregoing, together with other features and advantages of the present invention, will become more apparent when referring to the following specification, claims and accompanying drawings.

BRIEF DESCRIPTION OF THE DRAWINGS

Various features of the present invention will be better understood from the following detailed description of an exemplary embodiment of the invention, taken in conjunction with the accompanying drawings in which like reference numerals refer to like parts.

DETAILED DESCRIPTION OF THE INVENTION

The following detailed description is of the best currently contemplated modes of carrying out the invention. The description is not to be taken in a limiting sense, but is made merely for the purpose of illustrating the general principles of the invention, since the scope of the invention is best defined by the appended claims.

In the following description, certain terminology is used to describe certain features of one or more embodiments of the invention. The term "gun" refers to any type of firearm, including a pistol, revolver, shot gun, double barrel shot gun, etc. The term "stock" refers to any type of device for holding a gun, including a handle, a grip and a handgrip. The term "projectile" refers to any type of object that is capable of being fired from a toy gun, including a rubber band and an elastic loop band.

One aspect of the invention provides a toy gun with an easy to use trigger mechanism for launching or firing projectiles. Conventional rubber band guns require complicated loading and trigger mechanisms which are difficult for users, especially small children, to operate. By contrast, the present toy gun provides a gun with easy to use loading and trigger mechanisms.

Figure 1:
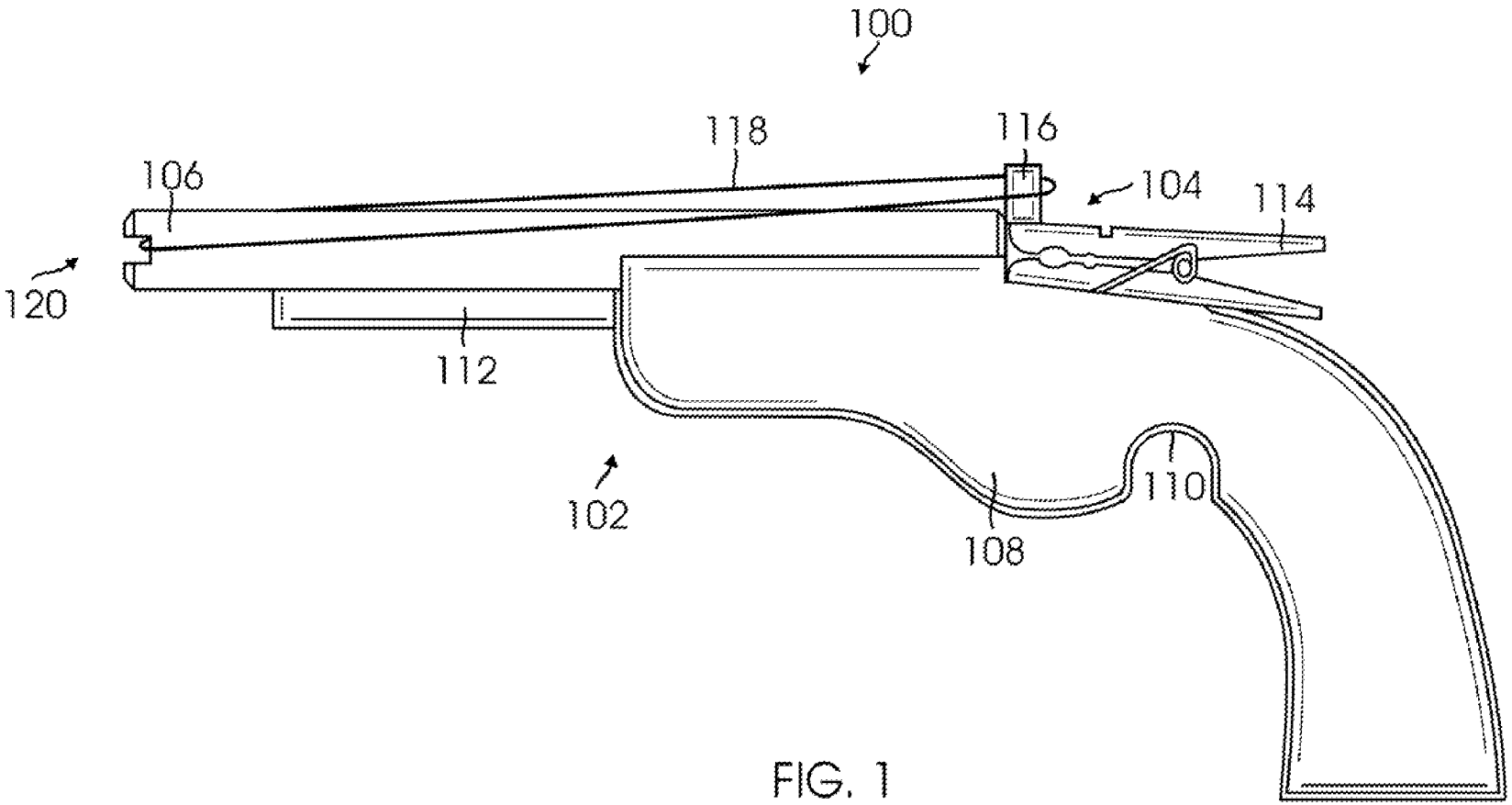
FIG. 1 illustrates a side view of a toy gun, resembling a pistol, for launching a projectile, according to one embodiment of the present invention.

FIG. 1 illustrates a side view of a toy, resembling a pistol, for launching a projectile, according to one embodiment of the present invention. The toy gun 100 includes a frame 102 coupled to a trigger mechanism 104. The frame 102 includes an elongated barrel 106, having a muzzle end and a non-muzzle end, mounted on top of a stock 108. The stock 108 includes a first end and a second end which functions as a gripping area or handle. The stock 108 is preferably formed of a solid material, such as wood, plastic, metal, etc., and has a notch 110 along the contour or periphery of the stock 108 replacing a traditional trigger used in conventional guns.

Figure 7:
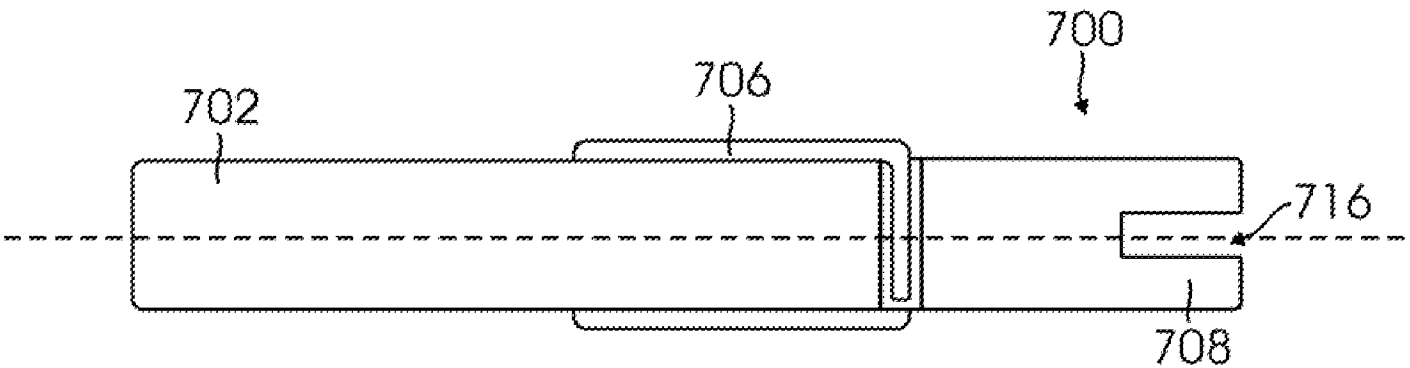
FIG. 7 illustrates a top plan view of a trigger mechanism, according to one embodiment of the present invention.

The trigger mechanism 104, mounted or secured to a top portion of the stock 108 and adjacent to the non-muzzle end of the elongated barrel 106, includes a release mechanism 114, moveable between a first position and a second or launch position, and a retaining member 116 extending upwardly through a longitudinal slit (as shown in FIG. 7) in the release mechanism 114. The longitudinal slit is sized to accommodate the retaining member 116 passing through it. The projectile or rubber band 118 includes a forward end loop and a rearward end loop. The rubber band 118 is stretched along the length of the elongated barrel 106 so that its forward end loop loops over a notch 120 in the muzzle end of the barrel 106 while its rearward end loop loops over the retaining member 116. In such 'loaded' position, the rubber band is under tension. In some implementations, the retaining member 116 may support one projectile 118. In other implementations, the retaining member 1 16 may support multiple projectiles.

To fire the gun 100 and release or launch the projectile 118, the release mechanism 114 is manually depressed (as described below with reference to FIGS. 7 and 8) causing the release mechanism 114 to move from the first position to the second position. When in the second position, the end of the release mechanism 114 contacts the rubber band 118 forcing the rubber band 118 upward over the retaining member 116. This allows the rubber band 118 to immediately deploy/launch and project away from the toy gun 100.

In some implementations, the frame 102 may also include an elongated ejection rod 112 mounted below the elongated barrel 106 and in front of the first end of the stock 108 to more closely resemble a typical pistol.

Figure 2:
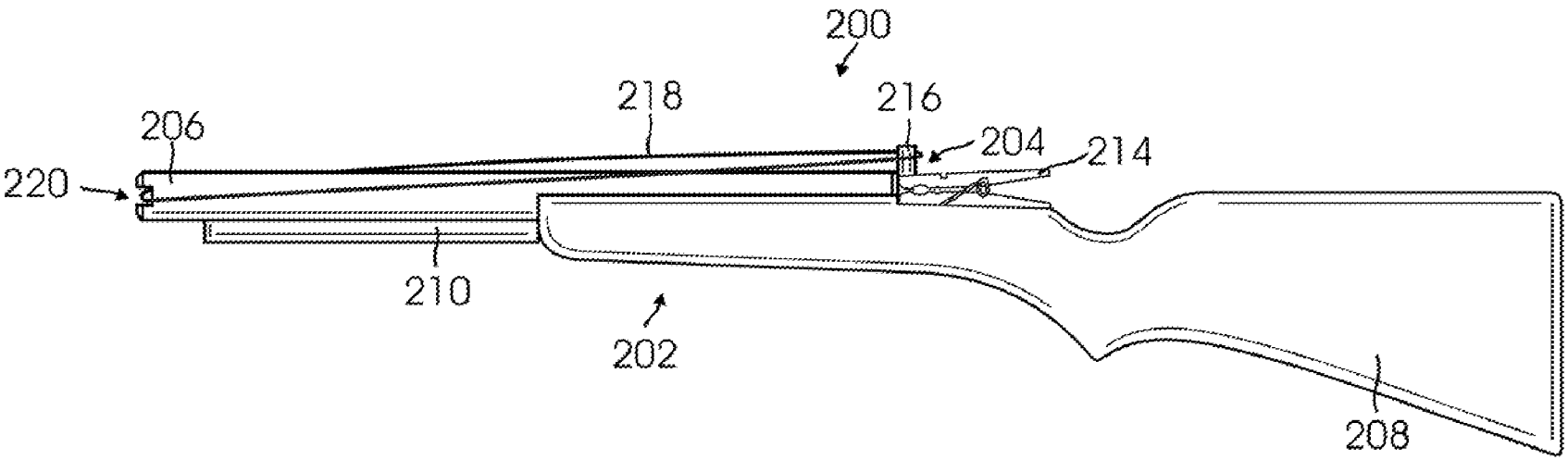
FIG. 2 illustrates a side view of a toy gun, resembling a shot gun, for launching a projectile, according to one embodiment of the present invention.

FIG. 2 illustrates a side view of a toy gun 200, resembling a single barrel shot gun, for launching a projectile, according to one embodiment of the present invention. As with the toy gun 100 described with reference to FIG. 1, the toy gun 200 of FIG. 2 includes a frame 202 coupled to a trigger assembly 204 where the frame 202 includes an elongated barrel 206, having a muzzle end and a non-muzzle end, mounted on top of a stock 208. The stock 208 includes a first end, and a second end which functions as a gripping area or handle. The stock 208 is preferably formed of a solid material, such as wood, plastic, metal, etc.

The trigger mechanism 204, mounted or secured to a top portion of the stock 208, adjacent to the non-muzzle end of the elongated barrel 206, includes a release mechanism 214, moveable between a first position and a second or launch position, and a retaining member 216 extending upwardly through a longitudinal slit (as shown in FIG. 7) in the release mechanism 214. The longitudinal slit is sized to accommodate the retaining member 216 passing through it. The projectile or rubber band 218 includes a forward end loop and a rearward end loop. The rubber band 218 is stretched along the length of the elongated barrel 206 so that its forward end loop loops over a notch 220 in the muzzle end of the barrel 206 while its rearward end loop loops over the retaining member 216. In such 'loaded' position, the rubber band is under tension. In some implementations, the retaining member 216 may support one projectile 218. In other implementations, the retaining member 216 may support multiple projectiles.

As with the gun 100 in FIG. 1, the gun 200 in FIG. 2 is fired by manually depressing (as described below with reference to FIGS. 7 and 8) the release mechanism 214 from the first position to the second position. When in the second position, the end of the release mechanism 214 contacts the rubber band 218 forcing the rubber band 218 upward over the retaining member 216. This allows the rubber band 218 to immediately deploy/launch and project away from the toy gun 200.

In some implementations, the frame 202 may also include an elongated ejection rod 210 mounted below the elongated barrel 206 and in front of the first end of the stock 208 to more closely resemble a typical shot gun.

Figure 3:
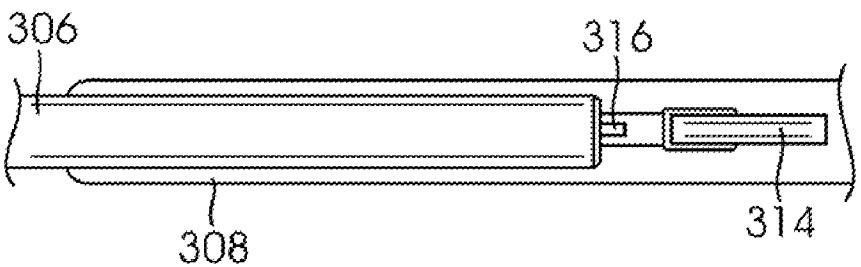
FIG. 3 illustrates a fragmentary top view of the toy guns of FIGS. 1 and 2.

FIG. 3 illustrates a fragmentary top view of the toy guns of FIGS. 1 and 2 showing an elongated barrel 306 secured on a top portion of a stock 308 and a release mechanism 314 having a retaining member 316 extending upwardly through a longitudinal slit (as shown in FIG. 7). The longitudinal slit is sized to accommodate the retaining member 316 passing through it.

Figure 4:
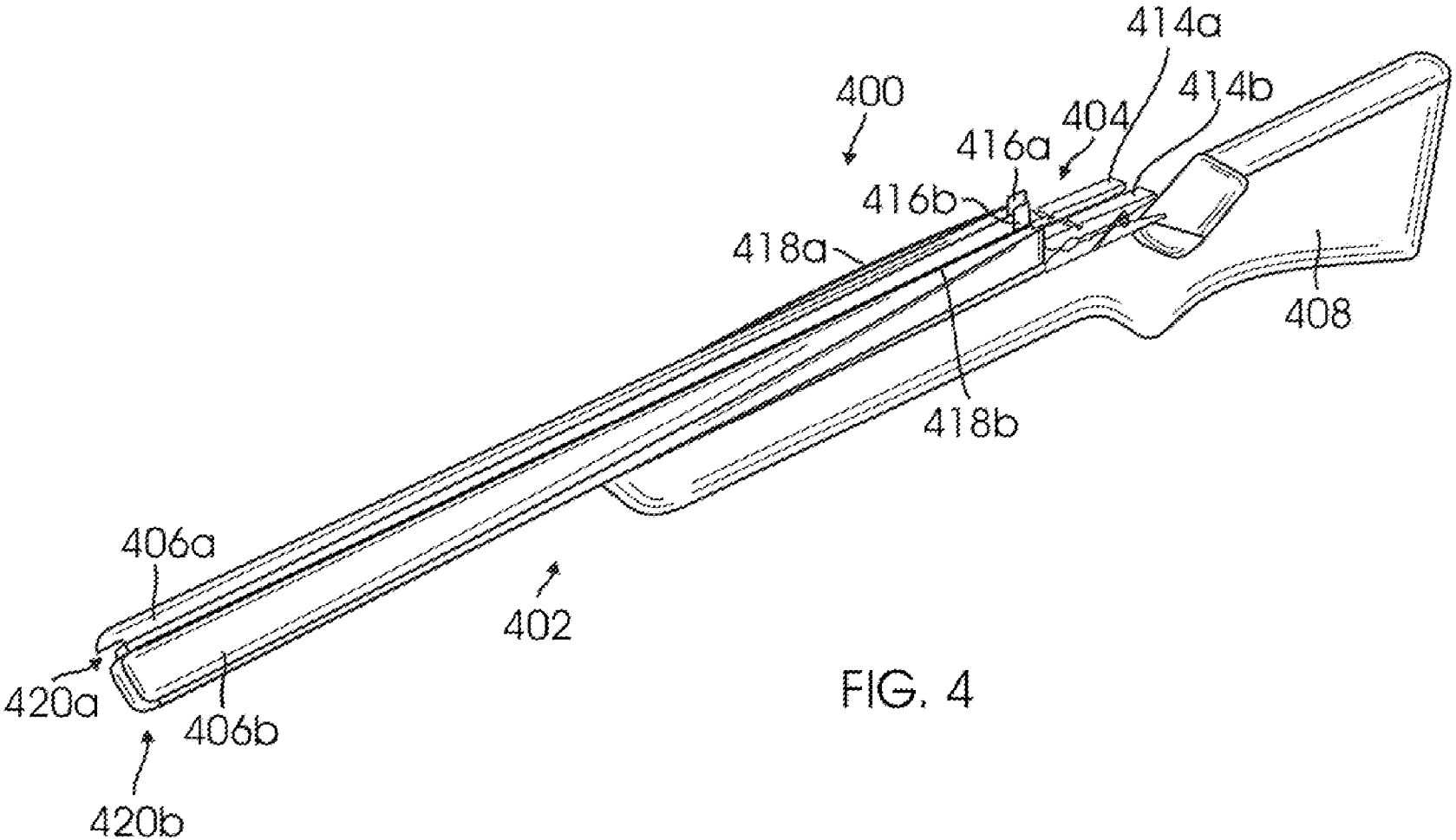
FIG. 4 illustrates a side perspective view of a toy gun, resembling a double barrel shot gun, for launching a projectile, according to one embodiment of the present invention.

FIG. 4 illustrates a side perspective view of a toy gun 400, resembling a double barrel shot gun, for launching multiple projectiles, according to one embodiment of the present invention. The toy gun 400 includes a frame 402 coupled to a trigger mechanism 404. The frame 402 includes first and second elongated barrels 406*a* and 406*b*, having muzzle and non-muzzle ends, mounted on top of a stock 408. The stock 408 includes a first end and a second end which functions as a gripping area or handle. The stock 408 is preferably formed of a solid material, such as wood, plastic, metal, etc.

The trigger mechanism 404, mounted or secured to a top portion of the stock 408, adjacent to the non-muzzle ends of the elongated barrels 406*a* and 406*b*, includes first and second release mechanisms 414*a* and 414*b*, movable between a first position and a second or launch position, and first and second retaining members 416*a* and 416*b* extending upwardly through longitudinal slits (as shown in FIG. 7) in the first and second release mechanisms 414*a* and 414*b*.

The projectiles, or rubber bands, 418*a* and 418*b* each include a forward end loop and a rearward end loop. The rubber bands 418*a* and 418*b* are stretched along the length of the first and second elongated barrels 406*a* and 406*b*, respectively, so that their forward end loops loop over first and second notches 220*a* and 220*b*, respectively, in the muzzle ends of the elongated barrels 406*a* and 406*b* while their rearward end loops loop over the first and second retaining members 416*a* and 416*b*, respectively. In some implementations, the retaining members 416*a* and 416*b* may support one projectile. In other implementations, the retaining members 416*a* and 416*b* may support multiple projectiles.

As with the guns 100 and 200 in FIGS. 1 and 2, the gun 400 in FIG. 4 is fired by manually depressing (as described below with reference to FIGS. 7 and 8) the first and/or second release mechanisms 414*a* and 414*b* from the first position to the second position. The longitudinal slits are sized to accommodate the retaining members 416*a* and 416*b* passing through. The first and second release mechanisms 414*a* and 414*b* may be depressed separately or simultaneously. When in the second position, the ends of the release mechanisms 414*a* and 414*b* contact the rubber bands 418*a* and 418*b* forcing the rubber bands 418*a* and 418*b* upward over the retaining members 416*a* and 416*b*. This allows the rubber bands 418*a* and 418*b* to immediately deploy/launch and project away from the toy gun 400.

Figure 5:
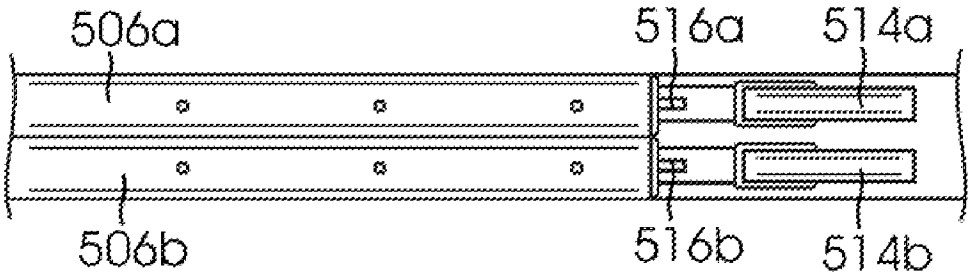
FIG. 5 illustrates a fragmentary top view of the toy gun of FIG. 4.

FIG. 5 illustrates a fragmentary top view of the toy gun of FIG. 4 showing first and second elongated barrels 506*a* and 506*b* secured on a top portion of a stock 508 and first and second release mechanisms 514*a* and 514*b* having first and second retaining members 516*a* and 516*b* extending upwardly through longitudinal slits (as shown in FIG. 7). The longitudinal slits are sized to accommodate the first and second retaining members 516*a* and 516*b* passing through them.

Figure 6:
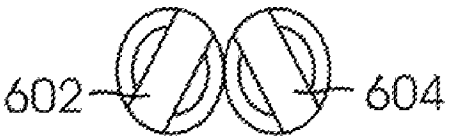
FIG. 6 illustrates a fragmentary front view of the toy gun of FIG. 4.

FIG. 6 illustrates a fragmentary front view of the toy gun of FIG. 4 showing a first notch 602 in the muzzle end of the first elongated barrel and a second notch 604 in the muzzle end of the second elongated barrel.

Figure 8:
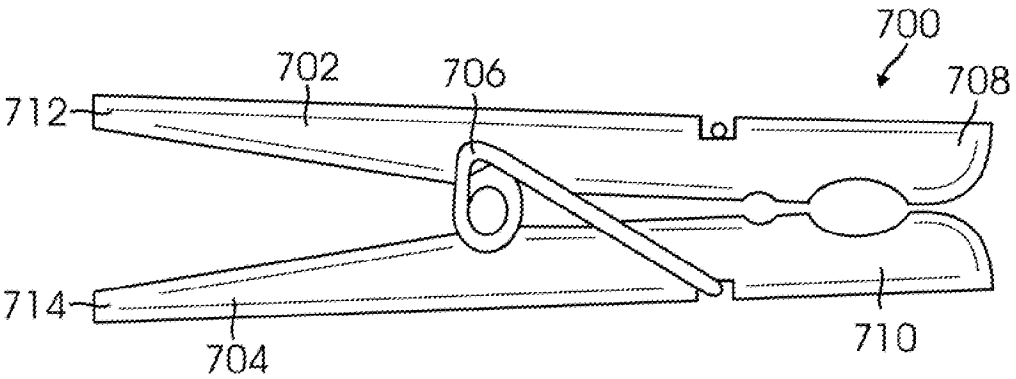
FIG. 8 illustrates a side view of the trigger mechanism of FIG. 7.

FIGS. 7 and 8 illustrate a top plan view and side elevation view, respectively, of one example of a release mechanism 700 resembling a conventional clothes pin. The release mechanism 700 has two legs, an upper leg and a lower leg 702, 704, each of which may have a longitudinal slit 716 for inserting a retaining member (as described above). That is, the slit 716 allows at least a portion of a retaining member to pass through. In an alternative second embodiment, only the upper leg 702 has a longitudinal slit 716 as the lower leg 704 and retaining mechanism are made as one-piece.

The upper and lower legs 702, 704 are connected by a spring 706 so that an upper leg extension 708 of the upper leg 702 is biased into contact with a lower leg extension 710 of the lower leg 704 allowing the upper leg extension 708 to move from a first position to a second or launch position. The upper and lower legs 702, 704 have upper and lower handles 712, 714 which are opposite to the upper and lower leg extensions 708 and 710 of upper and lower legs 702 and 704, respectively. The user manually depresses the upper handle 712 to overcome the force applied by the spring 706 to move the upper leg extension 708 upwards. The slit 716 allows the upper leg extension 708 to slide unobstructed by the retaining member that passes through it. As the upper leg extension 708 moves upwards, it contacts a projectile (under tension) that is looped around the retaining member. This causes the projectile to move upward over the retaining member and immediately deploy, launch and/or project away from the gun.

In alternative implementations, the release mechanism 700 may include a plurality of side-by-side slits to accommodate multiple retaining members. This may allow releasing multiple projectiles with the single release mechanism.

In some implementations, the toy gun may be made as one-piece and may be formed of wood, plastic, metal or any other suitable materials.

Figure 9:
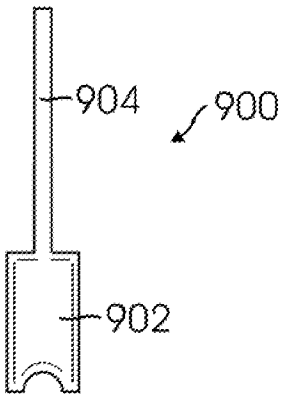
FIG. 9 illustrates a front view of a retaining member for securing a projectile to a gun, according to one embodiment of the present invention.

FIG. 9 illustrates a front view of a retaining member 900 for securing a projectile to a gun, according to one embodiment of the present invention. The retaining member 900 includes a base 902 for securing the retaining member 900 to the stock of a gun and a protrusion or extension 904 extending upwardly from the base 904. The extension 904 may retain one end of a projectile under tension and may be sized to extend through a longitudinal slit in a release mechanism, as described above. The extension 904 may have smooth rounded corners to prevent a user from injury, such as poking himself in the eye.

Figure 10:
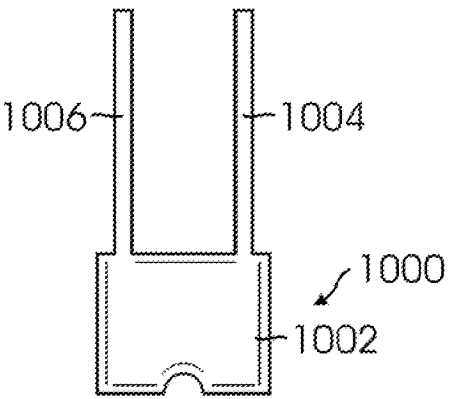
FIG. 10 illustrates a front view of a retaining member for securing one or more projectiles to a gun, according to one embodiment of the present invention.

FIG. 10 illustrates a front view of a retaining member 1000 for securing one or more projectiles to a gun, according to one embodiment of the present invention. The retaining member 1000 includes a base 1002 for securing the retaining member 1000 to the stock of a gun, a first extension 1004 extending upwardly from the base 1002 for retaining a first projectile and a second extension 1006, parallel to the first extension 1004 and separated by a distance, extending upwardly from the base 1002 for retaining a second projectile. In one implementation, the first and second extensions 1004 and 1006 are the same length. The first and second extensions 1004 and 1006 may have smooth rounded corners to prevent a user from injury, such as poking himself in the eye.

In an alternative second implementation, the first and second extensions 1004 and 1006 are different lengths. This may allow a single trigger to be used that, when depressed, causes two separate projectiles (e.g., rubber bands under tension) to be released at different times.

Figure 11:
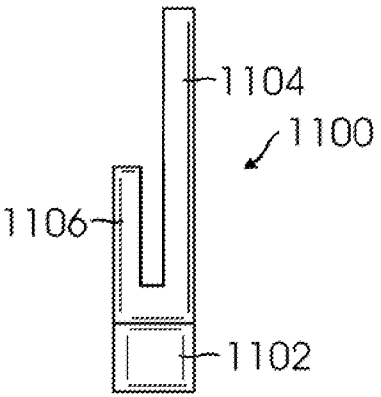
FIG. 11 illustrates a side view of a retaining member for securing one or more projectiles to a gun, according to one embodiment of the present invention.

FIG. 11 illustrates a side view of a retaining member 1100 for securing one or more projectiles to a gun, according to one embodiment of the present invention. The retaining member 1100 includes a base 1102 for securing the retaining member 1100 to the stock of a gun and first and second extensions 1104 and 1106 extending upwardly from the base 1102. The first extension 1104 is located directly in front of and parallel to the second extension 1106 and is shorter in length than the second extension 1106. The first and second extensions 1104 and 1106 may be sized to pass through the same slit in a release mechanism. In one implementation, the second extension 1106 is positioned in the gun so that it is closer to the front, or muzzle end, of the barrel of the gun. A first projectile (e.g., rubber band) is then loaded by attaching it over the front of the barrel of the gun, in a notch, and over the first extension 1104. A second projectile (e.g., rubber band) is then loaded by attaching it to the front of the barrel of the gun, in the notch, and over the second extension 1106. The first and second extensions 1104 and 1106 may have smooth rounded corners to prevent a user from injury, such as poking himself in the eye.

To launch projectiles from a gun using the retaining member 1100 of FIG. 11, a user manually depresses an upper handle of an upper leg of a release mechanism (as described with reference to FIGS. 7 and 8) causing an upper leg extension to move upward. As the upper leg extension moves upward a first distance, it causes the second projectile to be released or launched from the second extension 1106. As the upper leg extension moves further upwards a second distance, it pushes the first projectile over the first extension 1104 and launches the first projectile.

Figure 12:
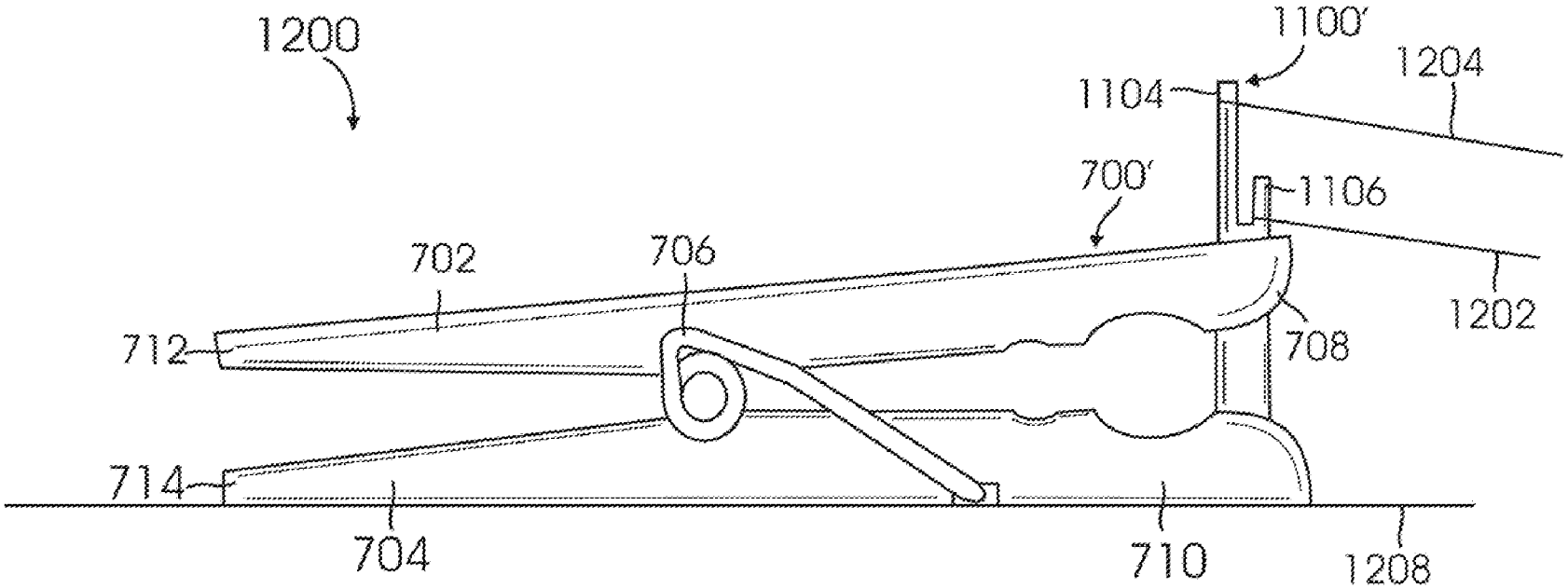
FIG. 12 illustrates a side view of a trigger mechanism in a partially launched position.

FIG. 12 illustrates a side view of a trigger mechanism 1200, in a partially launched position, secured to a top portion a stock 1208. The trigger mechanism 1200 includes a release mechanism 700' and a retaining mechanism 1100' loaded with first and second projectiles 1204 and 1202. The release mechanism 700' is otherwise identical to the release mechanism 700 in FIG. 7 and like reference numerals have been used for like parts as appropriate. Furthermore, the retaining mechanism 1100' is otherwise identical to the retaining mechanism 1100 in FIG. 11 and like reference numerals have been used for like parts as appropriate. As the upper leg extension 708 moves upward a first distance, it causes the second projectile 1106 to be released or launched from the second extension 1106 as is shown in FIG. 13.

Figure 13:
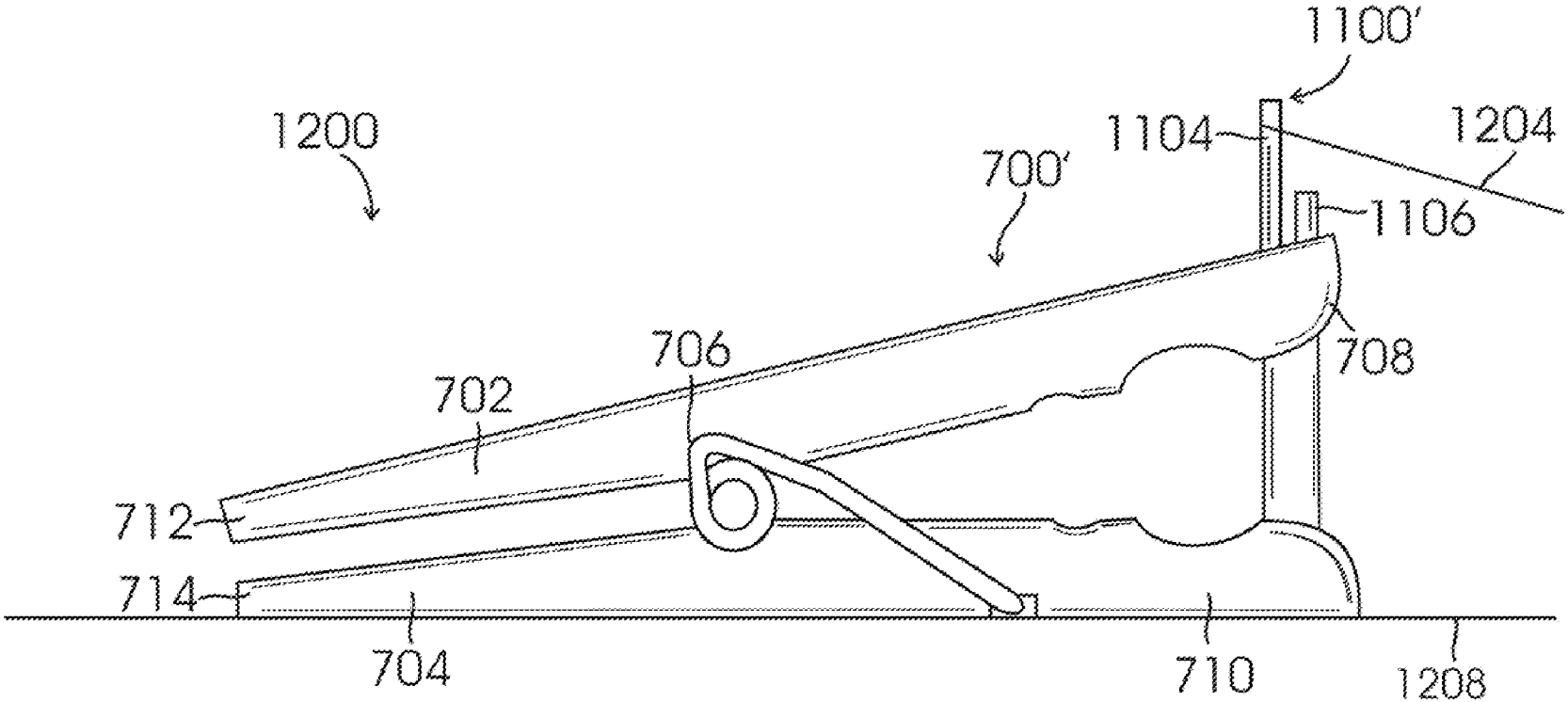
FIG. 13 illustrates a side view of a trigger mechanism in a fully launched position.

FIG. 13 illustrates a side view of the trigger mechanism 1200 of FIG. 12, in a fully launched position with a second projectile 1202 launched, secured to a top portion the stock 1208. The trigger mechanism 1200 includes a release mechanism 700' and a retaining mechanism 1100' loaded with only the first projectile 1204 as the second projectile 1202 was deployed when the trigger mechanism 1200 was moved to a partially launched position, as shown in FIG. 12. The release mechanism 700' is otherwise identical to the release mechanism 700 in FIG. 7 and like reference numerals have been used for like parts as appropriate. Furthermore, the retaining mechanism 1100' is otherwise identical to the retaining mechanism 1100 in FIG. 11 and like reference numerals have been used for like parts as appropriate.

As described with reference to FIG. 11, the second projectile 1202 is launched as a user manually depresses the upper handle of a release mechanism causing the upper leg extension 708 to move upward. As the upper leg extension 708 moves upward a first distance, it causes the second projectile 1202 to be released or launched from the second extension 1104 resulting in the trigger mechanism 1200 as shown in FIG. 13 with the second projectile 1202 deployed. As the upper leg extension 708 moves further upwards a second distance, it pushes the first projectile 1204 over the first extension 1104 and launches the first projectile 1204.

in alternative implementations, additional extension (e.g., three, four, etc.) of different lengths may be employed where the shorter extension is positioned toward the front of the gun barrel. The additional extensions may be in-line with each other and sized to pass through one ore more slits in the release mechanism. This allows a plurality of projectiles to be released at different times as the release mechanism is depressed.

One or more of the components and functions illustrated in FIGS. 1, 2, 3, 4, 5, 6, 7, 8, 9, 10, 11, 12 and/or 13 may be rearranged and/or combined into a single component or embodied in several components without departing from the invention. Additional elements or components may also be added without departing from the invention.

While certain exemplary embodiments have been described and shown in the accompanying drawings, it is to be understood that such embodiments are merely illustrative of and not restrictive on the broad invention, and that this invention is not be limited to the specific constructions and arrangements shown and described, since various other modifications may occur to those ordinarily skilled in the art.

The invention claimed is:

1. A toy gun for launching projectiles, comprising:

a stock including a first end and a second end;

an elongated barrel including a non-muzzle end and a muzzle end, the non-muzzle end secured to a portion of a top of the stock;

a trigger mechanism secured on the portion of the stock adjacent to the non-muzzle end of the elongated barrel for releasing a projectile, the trigger mechanism comprising:

a release mechanism including a lower leg secured to the top portion of the stock and an upper leg connected to the lower leg by a spring, the upper leg moveable between a first position and a second position; and at least one retaining member extending upwardly through at least one longitudinal slit in the upper leg, the at least one retaining member including first and second extensions for launching multiple projectiles.

2. The gun of claim 1, wherein the projectile includes a forward end loop and a rearward end loop and is stretched along a horizontal length of the elongated barrel; and wherein the forward end loop is secured over a notch in the non-muzzle end of the elongated barrel and the rearward end loop is secured around an extension of the at least one retaining member.

3. The gun of claim 1, wherein the upper leg includes an upper handle and an upper leg extension opposite the upper handle; and wherein the lower leg includes a lower handle and a lower leg extension opposite the lower handle.

4. The gun of claim 3, wherein the first extension has a length shorter than a length of the second extension; and wherein the first extension is directly in front of and spaced apart from the second extension.

5. The gun of claim 4, wherein depressing the upper handle of the upper leg of the release mechanism causes the upper leg extension of the upper leg to move upward a first distance causing the second projectile to launch from the second extension.

6. The gun of claim 5, wherein further depressing the upper handle of the upper leg of the release mechanism causes the upper leg extension of the upper leg to move upward a second distance causing the first projectile to launch from the first extension.

7. The gun of claim 1, wherein the first extension has a length the same as a length of the second extension; and wherein the first extension is located next to and parallel to the second extension.

8. The gun of claim 1, wherein the trigger mechanism is a clothes pin.

9. The gun of claim 1, wherein the projectile is a rubber band.

10. The gun of claim 1, wherein the upper leg is in the first position when the upper leg extension of the upper leg contacts the lower leg extension of the lower leg.

11. The gun of claim 1, wherein the upper leg is in the second position when the upper leg extension of the upper leg contacts the lower leg extension of the lower leg.

12. The gun of claim 11, wherein the projectile is launched as the upper leg moves from the first position to the second position.

13. A toy gun for launching projectiles, comprising:

a stock including a first end and a second end;

a first elongated barrel including a non-muzzle end and a muzzle end, the non-muzzle end secured to a portion of a top of a stock;

a second elongated barrel including a non-muzzle end and a muzzle end, the non-muzzle end secured to the top portion of the top of the stock and adjacent to the first elongated barrel;

a trigger mechanism secured on the top portion of the stock adjacent to the non-muzzle ends of the first and second elongated barrels for releasing at least one projectile, the trigger mechanism comprising:

a first release mechanism including a first lower leg secured to the top portion of the stock and a first upper leg connected to the first lower leg by a first spring, the first upper leg moveable between a first position and a second position;

a second release mechanism including a second lower leg secured to the top portion of the stock and a second upper leg connected to the second lower leg by a second spring, the second upper leg moveable between an upper position and a lower position;

a first retaining member extending upwardly through a first longitudinal slit in the first upper leg; and a second retaining member extending upwardly through a second longitudinal slit in the second upper leg.

14. The gun of claim 13, wherein the first retaining member includes first and second extensions for launching multiple projectiles; and wherein the second retaining member includes third and fourth extensions for launching multiple projectiles.

15. The gun of claim 14, wherein the first and third extensions have a length shorter than a length of the second and fourth extensions; and wherein the first and third extensions are directly in front of the second and fourth extensions.

16. The gun of claim 15, wherein the first and second upper legs include first and second upper handles and first and second upper leg extensions opposite the first and second upper handles; and wherein the first and second lower legs includes first and second lower handles and first and second lower leg extensions opposite the first and second lower handles.

17. The gun of claim 16, wherein the first and third extensions have a length shorter than a length of the second and fourth extensions; and wherein the first and third extensions are directly in front of and spaced apart from the second and fourth extensions.

18. The gun of claim 17, wherein depressing the first and second upper handles of the first and second upper legs causes the first and second upper leg extensions to move upward a first distance causing projectiles to launch from the second and fourth extensions.

19. The gun of claim 18 wherein further depressing the first and second upper handles of the first and second upper legs cause the first and second upper leg extensions to move upward a second distance causing additional projectiles to launch from the first and third extensions.

* * * * *